US005271560A

United States Patent [19]

De Winter

[11] Patent Number: 5,271,560

[45] Date of Patent: Dec. 21, 1993

[54] DRIP DISPENSER

[75] Inventor: Koen De Winter, Beaconfield, Canada

[73] Assignee: West Sanitation Services, Inc., Harbor City, Calif.

[21] Appl. No.: 871,900

[22] Filed: Apr. 21, 1992

[51] Int. Cl.[5] ..... A61L 9/01

[52] U.S. Cl. ..... 239/42; 239/51; 239/600; 222/181

[58] Field of Search ..... 239/39, 42, 44, 51, 239/600; 222/181, 183, 185; 220/339

[56] References Cited

U.S. PATENT DOCUMENTS

| | | | |
|---|---|---|---|
| 681,100 | 8/1901 | Calkins | 239/42 |
| 893,208 | 7/1908 | Van Dyne | 239/51 |
| 975,925 | 11/1910 | Bach | 239/51 |
| 1,096,143 | 5/1914 | Williams | 239/51 |
| 1,099,720 | 6/1914 | Peck | 239/51 |
| 2,201,784 | 5/1940 | Myers | 239/51 |
| 2,238,935 | 4/1941 | Gumaer | 239/44 |
| 2,251,734 | 8/1941 | Fuld et al. | 239/42 |
| 4,513,885 | 4/1985 | Hogan | 222/183 |
| 4,621,749 | 11/1986 | Kanfer | 222/183 |
| 4,967,935 | 11/1990 | Celest | 222/181 |
| 5,115,951 | 5/1992 | Leslie et al. | 239/600 |

*Primary Examiner*—David M. Mitchell
*Assistant Examiner*—Lesley D. Morris
*Attorney, Agent, or Firm*—Darby & Darby

[57] ABSTRACT

A drip dispenser incorporating (a) a backplate for securing the dispenser to a support, the backplate having a first longitudinal edge having at least one cover lock, a hinge bearing longitudinal edge, at least one hinge locking port, and a liquid container support; (b) a liquid reservoir attached to the backplate, the liquid reservoir having a drip outlet for dispensing a liquid from the dispenser; and (c) a cover having a first longitudinal edge, a hinge bearing longitudinal edge having at least one hinge lock, and at least one cover lock receptacle is provided. The backplate and the cover are joined along their respective hinge bearing longitudinal edges by a trifold hinge which can be maintained in a single folded position by insertion of the hinge lock into the hinge locking port and in a trifold position at which the cover extends across and completely covers the backplate, and therefore, the reservoir. The cover, when in the trifold position, and flush with the backplate and with any support to which the dispenser is secured, and no spaces or hinges are visible. The cover lock is positioned to engage the cover lock receptacle when the hinge is in the trifold position.

13 Claims, 5 Drawing Sheets

FIG. 9
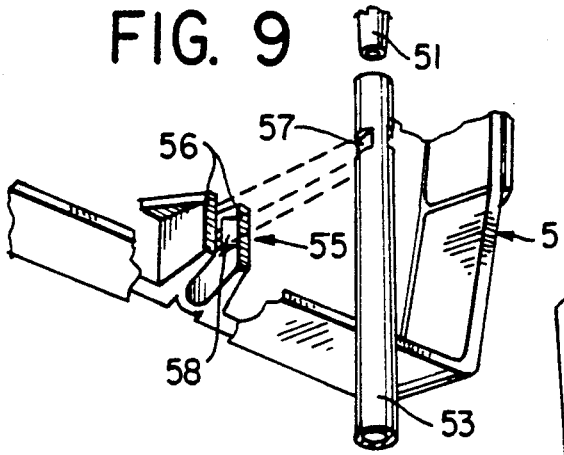
FIG. 10
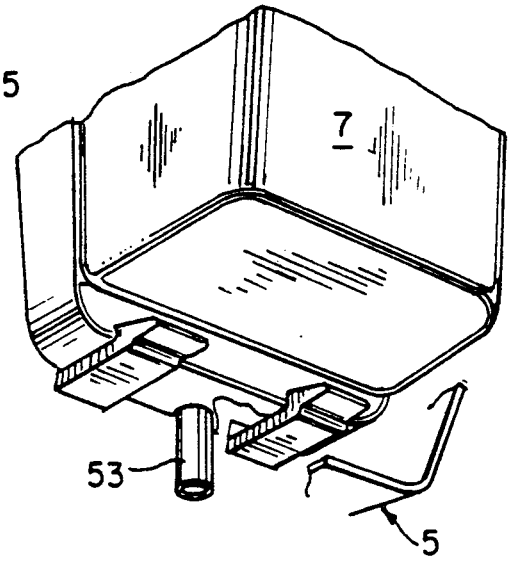
FIG. 11
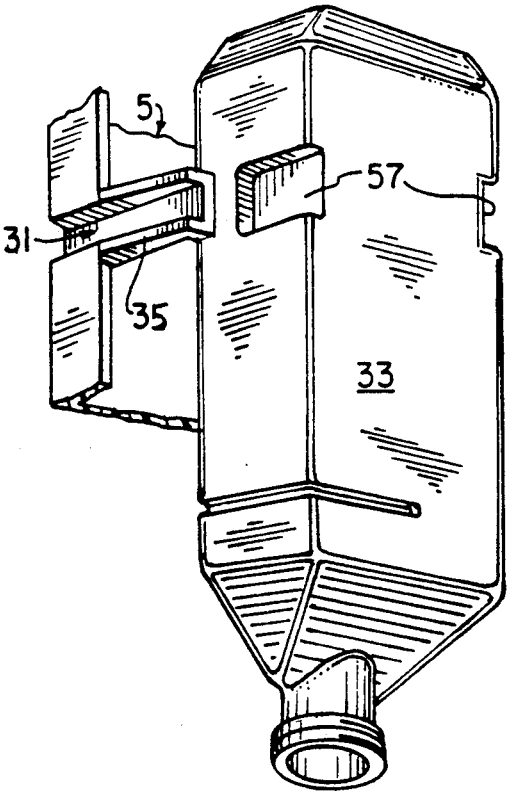
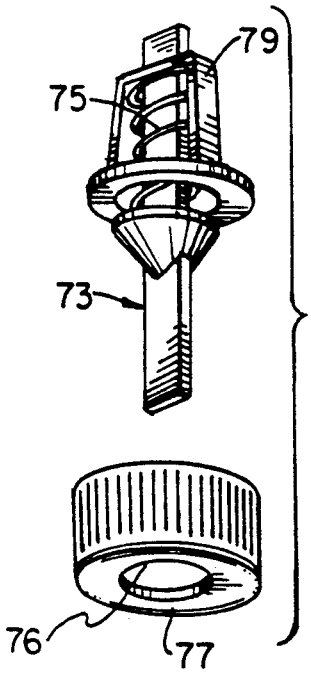
FIG. 12

DRIP DISPENSER

FIELD OF THE INVENTION

This invention relates to a drip dispenser for dispensing fluids, particularly detergents, antiseptics, and fragrance enhancers, to toilets and the like.

BACKGROUND OF THE INVENTION

Most drip dispensers include a backplate and a front cover. The front cover is either hinged to the backplate by a single visible and accessible hinge or is removable. The cover conceals a reservoir which receives a liquid to be dispensed and incorporates a delivery system that allows the liquid to be dispensed slowly, normally a drop at a time. Because most drip dispensers have more than one major component, the joining of these components with some type of fastening device or material is typically required.

Various attempts have been made to overcome the disadvantages of multi-piece construction. Commercially available dispensers incorporate a single living hinge to achieve a single molding objective. However, this hinge, which attaches a backplate to a cover, is visible when the dispenser is in a mounted position. Additionally, there is an unsightly opening between the cover and the backplate along the side opposite to the hinge and along the top and the bottom of the dispenser. The hinge becomes increasingly unsightly with age and wear.

Tampering is another problem to which drip dispensers are susceptible. Tampering typically results in loss of the contents of the dispenser and/or damage to the dispenser itself. Consequently, most drip dispensers incorporate some type of locking device. Typically, locking devices require obvious holes or gaps in the body of the dispenser where a key or some other tool is inserted.

The dispenser described above, for example, has a small widened area at the junction of the backplate and the cover into which a tool is inserted to release the cover from a catch attached to the backplate. Because the opening is readily visible and accessible, the cover can be pried open with a screwdriver or the like.

Other commercially available dispensers require a key or a special tool to open the unit. The key is inserted into a hole in the bottom of the dispenser. However, such dispensers are susceptible to opening when they are hit sharply in an upward direction. Alternatively, the key opening may become plugged, thereby preventing servicing of the dispenser.

The drip dispenser of the present invention is manufactured from a one piece molding wherein the cover completely covers the backplate and the reservoir. The cover fits flush with any support on which the dispenser is mounted, and there are no visible hinges or openings in the mounted dispenser other than an outlet from the reservoir for the liquid that is to be dispensed. A cover locking means is completely unaccessible when the dispenser cover is in the closed position. The interior is only accessible by the knowledgeable application of pressure to lift the cover slightly from the backplate along an unhinged edge and by inserting a suitable tool to disengage the hidden cover lock.

BRIEF DESCRIPTION OF THE DRAWINGS

FIG. 9 is an exploded detail perspective view of the drip dispenser dispensing tube;

FIG. 10 is a perspective view of the bottom portion of the drip dispenser;

FIG. 11 is a perspective detail view, with parts removed for clarity, of the liquid container support means and liquid container of the drip dispenser;

FIG. 12 is an exploded view of the valve arrangement for the liquid container of the drip dispenser;

SUMMARY OF THE INVENTION

According to the present invention, there is provided a drip dispenser comprising (a) a backplate for securing the dispenser to a support, the backplate having a first longitudinal edge having at least one cover locking means, a hinge bearing longitudinal edge, at least one hinge locking port, and a liquid container support means attached to the backplate; (b) a liquid reservoir attached to the backplate, the liquid reservoir having a drip outlet for dispensing a liquid from the dispenser; and (c) a cover having a first longitudinal edge, a hinge bearing longitudinal edge having at least one hinge locking means, and at least one cover locking means receptacle. The backplate and the cover are joined along their respective hinge bearing longitudinal edges by a trifold hinge which can be maintained in a single folded position by insertion of the hinge locking means into the hinge locking port and in a trifold position at which the cover extends across and completely covers the backplate, and therefore, the reservoir. The cover's edges, when in the trifold position, are flush with the backplate and the hinge is covered by the cover. The cover is also flush with any support on which the dispenser is secured and no spaces are visible. The cover locking means is positioned to engage the cover locking means receptacle when the hinge is in the trifold position.

A preferred embodiment comprises the backplate and cover above.

In a further preferred embodiment, the drip outlet is in communication with a dispensing means comprising a lockable dispensing tube. The lockable dispensing tube comprises (a) a hollow tube having at least one annular or semi-annular groove around at least a portion of the outer circumference of the tube which is adapted to engage a locking means, and (b) a locking means attached to the dispenser to engage the groove of the tube so that the tube cannot be moved along its length with respect to the locking means.

DETAILED DESCRIPTION OF THE INVENTION

FIGS. 1–13 illustrate, in schematic, perspective and cross-sectional views, a drip dispenser (1) constructed according to the present invention.

Figure 1:
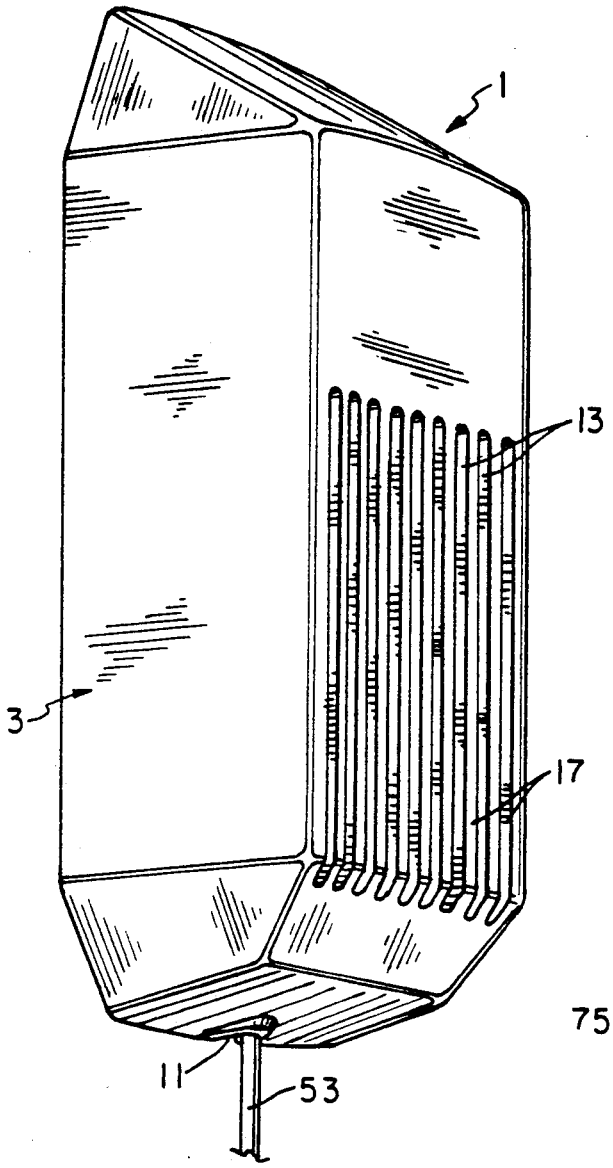
FIG. 1 is a perspective view of a drip dispenser constructed according to the present invention.

FIG. 1 illustrates the drip dispenser (1) with the cover (3) in the closed position. The backplate (5) (FIG. 3), the reservoir (7) (FIG. 7) and the trifold hinge (9) (FIG. 3), which is in the trifold position, are concealed from view and access by the cover (3). The only visible openings (11, 13) in the cover are at the point at which the dispensing tube (53) passes through the cover (3) (see also FIG. 10) or the louvers (17).

Figure 13:
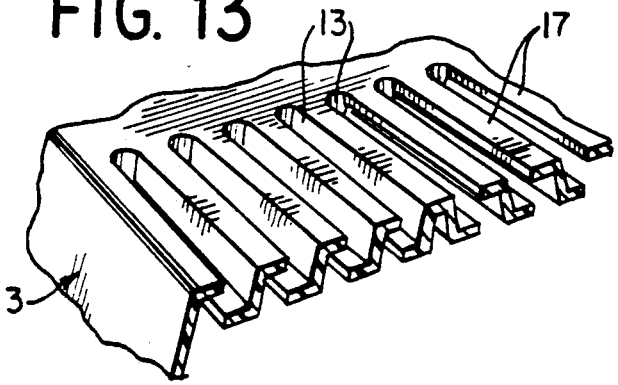
FIG. 13 is a perspective cross-sectional view of z-shaped cover louvers of the drip dispenser.

Access to the interior of the dispenser through the louvers, however, is severely restricted by the Z-shaped overlapping configuration of the louvers as illustrated in FIG. 13. This arrangement lessens the possibility of anyone inserting any foreign matter or an instrument through the louvers to pierce a liquid container inside the dispenser. The Z-shape of the louvers does not impede the flow of any fragrance from within the dispenser but the overlap of each individual louvre creates a curved path that is difficult for a straight instrument such as a needle or an icepick to travel to contact the liquid container. The louvers can optionally be reinforced with a rib (18) or the like.

Figure 2A:
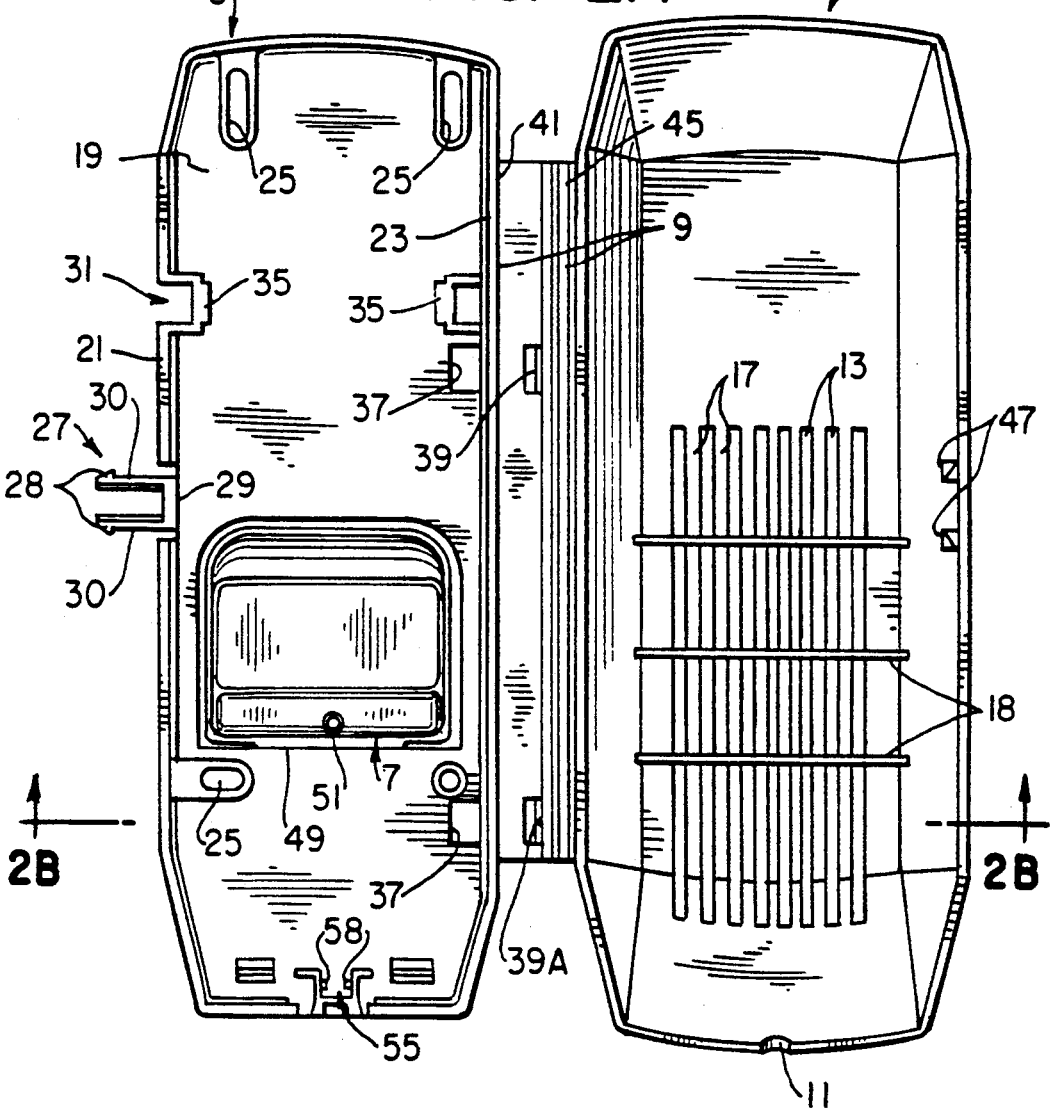
FIG. 2A is a front elevational view of a one piece molded drip dispenser as removed from the mold.
Figure 2B:
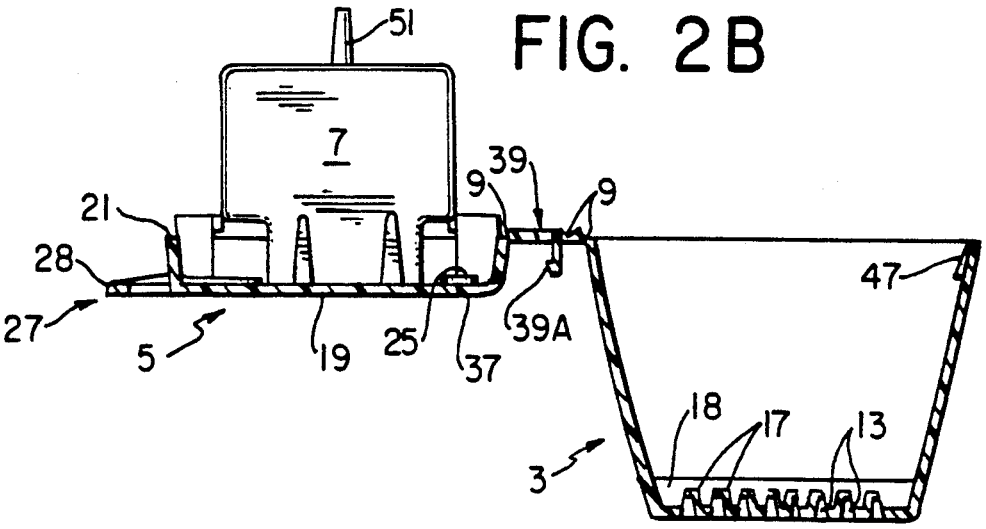
FIG. 2B is a sectional view taken along the line 2B—2B shown in FIG. 2A.

FIGS. 2A and 2B illustrate the drip dispenser as it is taken from the mold. The drip dispenser is preferably molded as one piece, eliminating any need for subsequent joining of components. Assembly is easy as the parts can not become detached or lost. Furthermore, one piece molding is relatively inexpensive.

Figure 3:
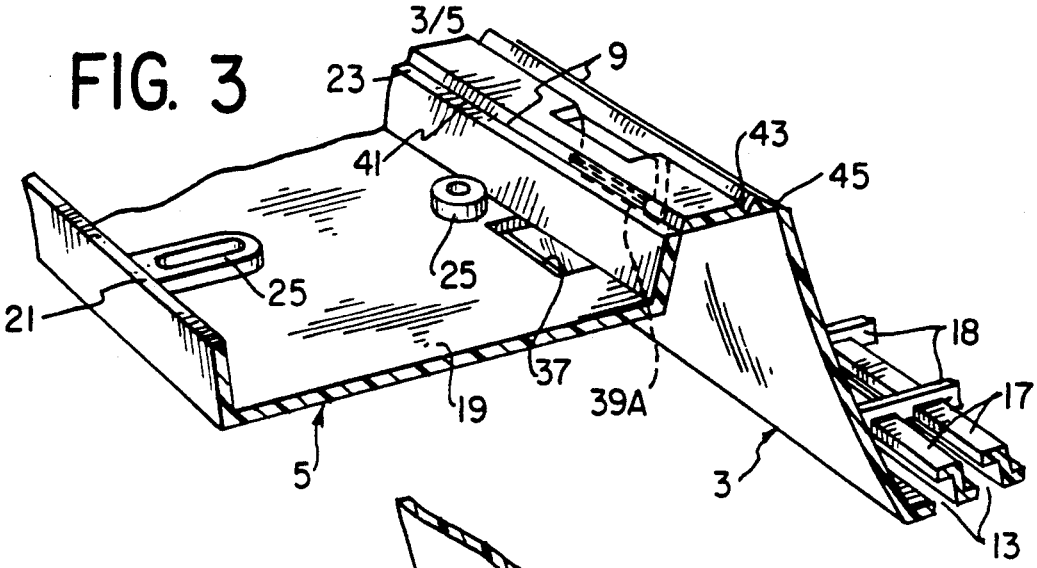
FIG. 3 is a horizontal cross-sectional detail view of a drip dispenser constructed according to the present invention with the trifold hinge in an unfolded position.
Figure 4:
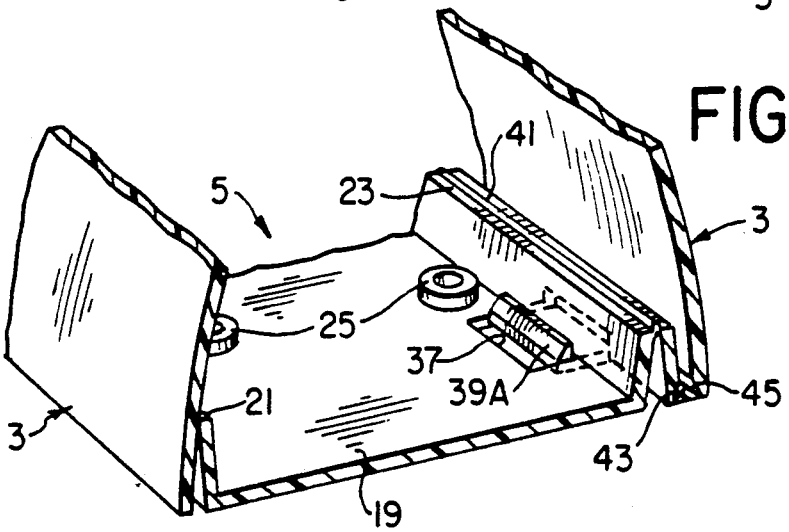
FIG. 4 is a horizontal cross-sectional detail view of a drip dispenser constructed according to the present invention showing a trifold hinge in the trifolded position.

FIGS. 3 and 4 illustrate the construction of the backplate (5) and the cover (3) and their connection through the trifold hinge (9). The backplate (5) preferably is comprised of a flat section (19), a first longitudinal edge (21) and a hinge bearing longitudinal edge (23), either or both of which may be disposed at an angle with respect to the flat section (19). Holes (25) may be provided in the backplate and preferably in the flat section (19) for mounting purposes, such as for the reception of a screw or a nail.

The hinge bearing longitudinal edge (23) of the backplate (5) is provided with at least one hinge locking port (37).

The trifold hinge (9) is preferably a living hinge, (i.e., made of the same material as the plastic dispenser, but in a thinner cross section) and is provided with one or more spaced hinge locking means (39) which, when the hinge is folded along a first fold line (41), are received in one or more corresponding hinge locking ports (37). Preferably, hinge locking means (39) are of a clip type having a beveled surface (39A) as illustrated in FIG. 4. The hinge lock prevents the trifold hinge side of the cover from being pivoted away from any support to which the dispenser is secured. This effectively prevents a cover in a closed and locked position from being disengaged by movement of the cover alone irrespective of any cover locking means as described below.

FIG. 4 illustrates the trifold hinge (9) in closed position, which is folded along second fold line (43) and third fold line (45) to achieve the trifolded position. In this position, the cover (3) straddles (i.e., covers) both longitudinal edges (21, 23) of the backplate (5).

Additionally as seen in FIG. 3, all hinge folds will be either interior to the cover or will be facing the support to which the backplate is attached, and therefore, will not be visible or accessible to anyone viewing the mounted drip dispenser.

Figure 5:
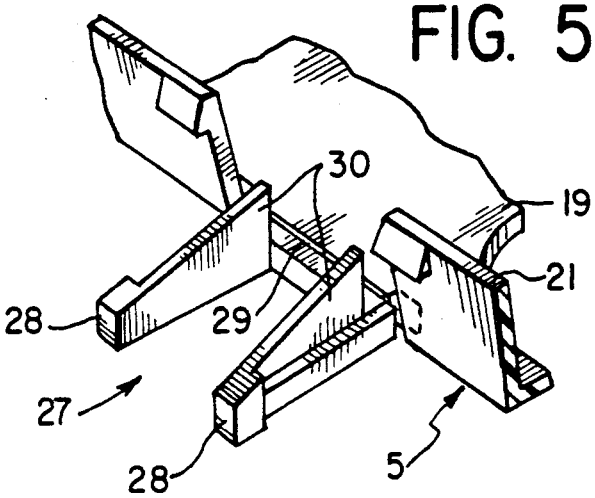
FIG. 5 is a detail view of the cover lock in an enlarged scale as removed from the mold.
Figure 6:
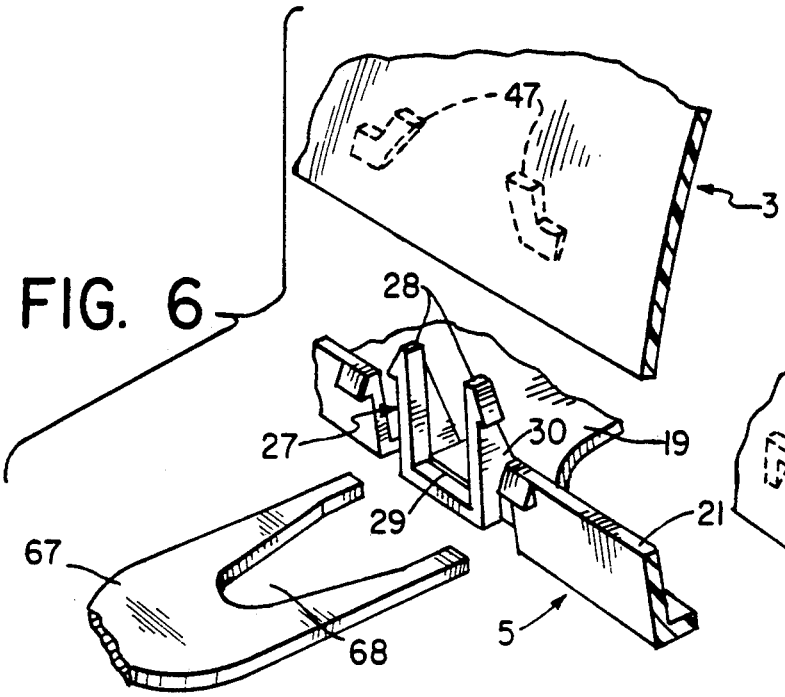
FIG. 6 is a perspective exploded view of the cover locking elements of the present invention.
Figure 6A:
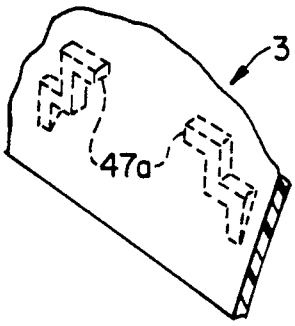
FIG. 6A is a perspective exploded view of a cover locking means receptacle of the present invention.

The cover locking system is illustrated in FIGS. 5, 6, and 6A. The first longitudinal edge (21) of the backplate is provided with at least one cover locking means (27). The cover locking means (27) is molded in any manner know to those of ordinary skill in the art. Preferably, it is molded in the plane of the flat section (19) of the backplate (5) and is rotated approximately 90° to a locking position around a hinge (29) that is preferably a living hinge. The cover locking means (27) preferably is a two prong clip type having tips (28) that extend outwardly of the arms (30) wherein pressure can be applied to the arms to compress them, preferably with a key (67), to release the cover as explained below.

The cover locking means (27) is adapted to engage a cover locking means receptacle (47) located on the interior of the cover (3). A preferred cover locking means receptacle is illustrated in FIG. 6A and comprises a thin shelf or wall-like structure (**47*a*). The cover locking means receptacles are preferably used in cooperation with the two prong clip type cover locking means described above. They are sized and proportioned to be positioned below the tips of the arms of the receptacle prongs by a preselected distance when in the locked position. This permits the cover to be moved slightly away from the back support in the closed position. The receptacles may be tapered and typically force the arms of the prongs and therefore the prongs together when the receptacle meets the locking means tips. When the prong tips are compressed, the receptacle can pass to a position below the tips. Once the tips pass the receptacle, the arms, and therefore, the prongs return to their former position, moving the tips to a position overlying the receptacles and creating the lock. The length of the arms is preferably slightly longer than the shortest distance between the bottom of the lock (27) and the locking means receptacle so that the cover can be opened slightly without unlocking it or unfolding the trifold hinge along the third fold line in order to facilitate opening. After the cover is moved slightly, preferably by the application of knowledgeable pressure so as to displace the locking side of the cover from the backplate slightly, a tool or key (67) can be inserted to pinch the clip type retainer together. The opening (68) between the legs of the key (67) tapers inwardly so that as the key is pushed around the lock arms the tips (28) of the arms (30) of the lock move toward each other until they clear the locking means receptacle (47**). Thus, the cover can now be swung to the open position about the trifold hinge. Therefore, no locking means is visible from the outside.

Figure 8:
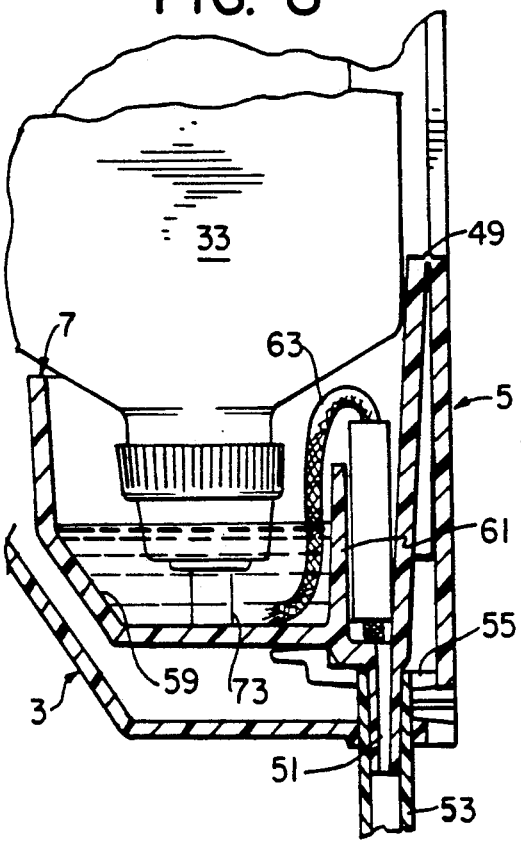
FIG. 8 is a vertical cross-sectional detail view of the reservoir portion shown in FIG. 7.
Figure 7:
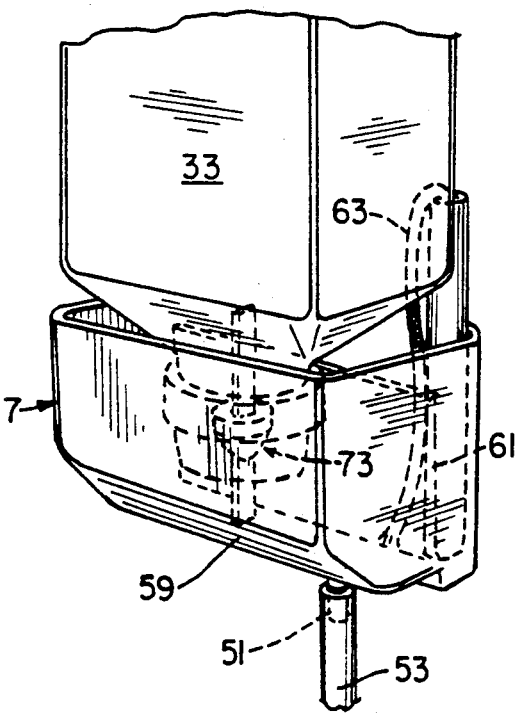
FIG. 7 is a perspective view, with parts broken away for clarity, of a reservoir of a drip dispenser constructed according to the present invention.

FIGS. 7 and 8 illustrate the construction of the reservoir (7). The reservoir (7) is attached to the backplate (5), preferably through a living hinge (49). In a typical molding operation, the reservoir is molded at a 90 degree angle with respect to its operating position in the dispenser and is rotated about this hinge (49) to its operating position. Optional means can be provided in the baseplate to secure the reservoir in its operating position.

The reservoir (7) receives a liquid from the liquid container (33) and dispenses the liquid through a drip outlet (51). Preferably, the drip outlet (51) is at the lowest point of the reservoir (7) and is in communication with a dispensing tube (53).

In a preferred embodiment, the reservoir is comprised of two chambers (59, 61). The first chamber (59) receives the liquid directly from the liquid container (33). The liquid is then transferred to the second chamber (61) by means of a wick (63) or the like. The second chamber (61) includes the drip outlet (51) through which the liquid passes out of the dispenser. The length or the number of wicks can be adapted to increase or to decrease the rate of flow. A shorter wick provides faster drip action. Preferred wicks are comprised of cotton rope-like materials.

Figure 9A:
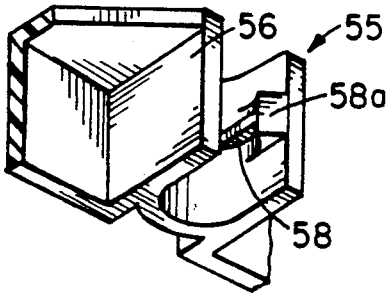
FIG. 9A is a perspective view of a dispensing tube locking means.
Figure 9B:
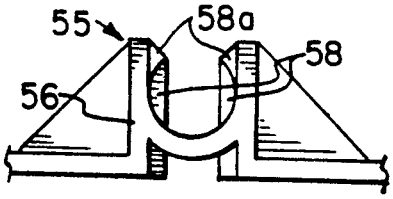
FIG. 9B is a top view of a dispensing tube locking means.

The dispensing tube (53) preferably is locked into position by a locking means (55) which prevents axial movement of the tube once it is in place and the cover is closed. The dispensing tube (53) is illustrated in FIG. 9. The tube is hollow and is provided with at least one annular or semi-annular groove (57) around at least a portion of its outer circumference. A locking means (55), further illustrated in FIGS. 9A and 9B, has spaced arms (56) which are preferably adapted to prevent the tube from being pulled from the dispenser in the radial direction. The arms (56) may include supplementary retaining clips (58*a*) further adapted to hold the tube. The arms, the supplementary clips, or both are provided with opposed rails (58) to engage the groove so that the tube can not be moved along its length with respect to the locking means. Preferably, the locking means is attached to the dispenser, and most preferably is attached to the backplate, the cover, or a combination thereof through the single molding process.

Figure 12A:
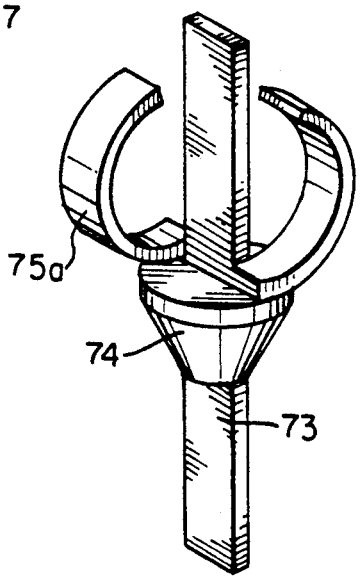
FIG. 12A is a perspective view of an integrated spring and plunger of a valve arrangement for the liquid container of the drip dispenser.

As seen in FIG. 11, the backplate (5) is also provided with a liquid container support means (31) which is adapted to hold a liquid container (33) containing the liquid to be dispensed, in a position so that it can feed liquid to the reservoir (7). A preferred liquid container contemplated by the present invention is molded to a shape similar to that of the interior space formed between the closed cover and the backplate. Preferably, the support means comprises one or more opposed arms (35) that are adapted to snap into grooves (57) on the liquid container. In a further preferred embodiment, a check type valve or stopper as illustrated in FIGS. 12 and 12A, comprising a plunger (73), a spring (75), a cap (77), and a retaining saddle (79) (or a plunger (73), an integrated spring and retaining saddle (75*a*) and a cap (77)), is used to close the liquid container (33). The spring (75) normally biases the seal (74) on the plunger (73) into sealing engagement with an opening (76) in the cap (77). The check stopper is adapted to control the flow of any liquid from the container.

To begin the drip operation, the liquid container (33) containing the liquid to be dispensed is inserted in an inverted position into the reservoir (7) and preferably into the first or receiving chamber (59) of the reservoir. This forces the plunger (73) upwardly to unseat the seal (74). Thus, chamber (59) fills with liquid until the outlet of the container is covered by the liquid. At that point, no more air can pass into the container, and the flow of liquid from the container is stopped until the liquid level in the reservoir falls below this level and air can again enter the container. The liquid passes from the first chamber (59) to the second chamber (61) through the wick (63) and drips out of the drip outlet (51) and through the dispensing tube (53).

The preferred material for construction of the drip dispenser is polypropylene because of its durability, low cost, flexibility, strength, and chemical resistance. However, other plastics with similar characteristics may be used as well. The cover can be of any configuration as can the backplate. Preferred material for construction of the dispensing tube is polyethylene.

Many variations of this invention will suggest themselves to those skilled in the art in light of the above, detailed description. All such obvious modifications are within the full intended scope of the appended claims.

What is claimed is:

1. A drip dispenser comprising:

(a) a backplate for securing said dispenser to a support, said backplate having a first longitudinal edge and a hinge bearing longitudinal edge; and (b) a cover having a first longitudinal edge and a hinge bearing longitudinal edge;

said backplate and said cover being joined along their respective hinge bearing longitudinal edges by a trifold hinge which can be maintained in a single folded position at which said cover hinge bearing longitudinal edge is flush with any support on which said dispenser is secured and a trifolded position at which said cover extends across and completely covers said backplate, said cover having edges which are flush with said backplate when said cover is in the trifolded position, whereby said hinge is covered by said cover.

2. A drip dispensing system comprising a drip dispenser as defined in claim 1, and a liquid container adapted lock onto said liquid container support means.

3. A drip dispenser comprising:

(a) a backplate for securing said dispenser to a support, said backplate having a first longitudinal edge having at least one cover locking means, a hinge bearing longitudinal edge, at least one hinge locking port, and a liquid storage container support means;

(b) a liquid reservoir attached to said backplate, said liquid reservoir having a drip outlet for dispensing a liquid from said dispenser; and (c) a cover having a first longitudinal edge, a hinge bearing longitudinal edge having at least one hinge locking means, and at least one covering locking means receptacle;

wherein said backplate and said cover are joined along their respective hinge bearing longitudinal edges by a trifold hinge which can be maintained in a single folded position by inserting said hinge locking means into said hinge locking port and in a trifolded position at which said cover completely covers said backplate and said reservoir, at which said cover is flush with any support on which said dispenser is secured with no spaces or hinges visible, and at which said cover locking means engages said cover locking means receptacle.

4. A drip dispenser as defined in claim 3 wherein said drip outlet is in communication with a dispensing means comprising;

a) a hollow tube having at least one annular or semi-annular groove around at least a portion of the outer circumference of said tube, said groove being adapted to engage a locking means; and b) a locking means attached to said dispenser, said locking means being adapted to engage said groove of said tube so that said tube cannot be moved along its length with respect to said locking means.

5. A drip dispenser as defined in claim 4 wherein said reservoir comprises a first chamber for receiving liquid from a liquid container and a second chamber having said drip outlet in communication with said dispensing means, said two chambers being in communication through a wick adapted to draw a liquid from said first chamber to said second chamber.

6. A drip dispenser as defined in claim 4 wherein said tube comprises polyethylene.

7. A drip dispenser as defined in claim 3 that is one piece.

8. A drip dispenser as defined in claim 7 that is molded.

9. A drip dispenser as defined in claim 3 wherein said liquid container support means comprises arms adapted to lock into corresponding grooves on a liquid storage container.

10. A drip dispensing system as defined in claim 9 wherein said liquid container is capped by a check stopper mechanism adapted to control the flow of any liquid from said container.

11. A drip dispenser as defined in claim 3 comprising polypropylene.

12. A drip dispenser as defined in claim 3 wherein said cover comprises Z-shaped louvers.

13. A drip dispenser as defined in claim 3 wherein said cover locking means comprises two prongs, said prongs each having an arm and a tip that extends outwardly of the arm, and said cover locking means receptacle being sized and proportioned to be positioned below said tips of said arms when in the locked position, but wherein said cover may be moved a distance sufficient to permit the insertion of a key to compress said arms, and therefore said tips, to unlock said cover.

* * * * *